US007472432B2

(12) United States Patent
Owen

(10) Patent No.: US 7,472,432 B2
(45) Date of Patent: Jan. 6, 2009

(54) BATHTUB INSERT "TAKE-FIVE"

(76) Inventor: Letty Ann Owen, P.O. Box 3543, Asheboro, NC (US) 27204

( * ) Notice: Subject to any disclaimer, the term of this patent is extended or adjusted under 35 U.S.C. 154(b) by 0 days.

(21) Appl. No.: 11/010,623

(22) Filed: Dec. 13, 2004

(65) Prior Publication Data

US 2005/0138724 A1 Jun. 30, 2005

Related U.S. Application Data

(60) Provisional application No. 60/533,881, filed on Dec. 30, 2003.

(51) Int. Cl.
*A47K 3/12* (2006.01)

(52) U.S. Cl. ..... 4/574.1; 4/573.1; 4/575.1; 4/579

(58) Field of Classification Search ..... 4/571.1, 4/573.1, 574.1, 575.1, 576.1, 578.1, 579, 4/580, 583; 601/136, 158
See application file for complete search history.

(56) References Cited

U.S. PATENT DOCUMENTS 1,510,647 A * 10/1924 Bomar ..... 4/583
2,541,029 A * 2/1951 Burton ..... 4/573.1
5,020,168 A * 6/1991 Wood ..... 4/573.1
5,189,747 A * 3/1993 Mundy et al. ..... 5/654
6,094,756 A * 8/2000 Carter ..... 4/578.1
6,357,061 B1 * 3/2002 Gonzalez ..... 4/580
2003/0163866 A1 * 9/2003 Northington et al. ..... 4/573.1

* cited by examiner

*Primary Examiner*—Robert M Fetsuga

(57) ABSTRACT

A bathtub insert that is used in combination with a standard bathtub (76) wherein, a top contour design (60) in an elongated shape, conforms to the curvature of the human body form. Includes and formed part of design (60) and a pair of arm rests (42) (44) and a hand rest (46) which is integrally part of upper back support rest (26), lower back support rest (28), seat support rest (30); and pair of leg supports (32) (34) (36) (38), and a foot rest (40) that is an extension of rest (30), which includes a pedestal support (51A/51B). Part of and in adherence to design (60) is a bottom contour design (62) that provides support to design (60) which conforms to the shape of a bathtub surface (72) in an angled curvature shape. Further providing and in coordination with design (62) is an entrance and exit area a in/out platform (52).

5 Claims, 14 Drawing Sheets

BATHTUB INSERT "TAKE-FIVE"

CROSS-REFERENCE TO RELATED APPLICATION

This application is entitled to the benefit of Provisional Patent Application Ser. No. 60/533,881 filed 2003 Dec. 30.

FEDERALLY SPONSORED RESEARCH

Not Applicable

SEQUENCE LISTING OR PROGRAM

Not Applicable

BACKGROUND OF THE INVENTION

1. Field of Invention

This invention relates to bathtubs, specifically to an insert for the standard tub.

2. Description of Related Art

Originally bathtubs provided a place to bathe, but more and more people are in need of comfort and relaxation. The problem occurs when the bather tries to relax in the standard bathtub. This problem can be solved with the proper support and comfort provided to the bather.

Previous approaches have been made and products known are the Reclined Tub Insert in patent 20030163866, to Northington, 2003 Sep. 4, was designed to allow the user to lie back in a reclined position for comfort. The insert is focused upon allowing the user to shampoo the hair without raising the head from the insert. Thus, upon close examination of this insert it will assist in some degree to the natural positioning for the body. However, it does not provide total support, comfort, and contour for the body of the user.

The Cushioned bathtub support apparatus in U.S. Pat. No. 6,691,337, to Banks, 2004 Feb. 17, was designed to provide an upper body support having a backrest portion with arm supports. Upon reviewing the apparatus it will provide partial support to the user. However, it does not provide total support, comfort, and contour for the body.

The Bathtub Therapeutic Pad in U.S. Pat. No. 4,037,591 to Samo, 1977 Jul. 26, was designed for comfort from a hard tub especially for people with skin ailments. This pad does provide protection for the user from direct contact with the surface of the bathtub. It does not provide the user with any type of natural proper support or comfort to the body.

The Bathing Seat in U.S. Pat. No. 5,535,458 to Siverly 1996 Jul. 16, the bathing seat, though partially contoured to the body, states that it provides support to the back and neck. Close examination of this seat does not provide support for the entire body to relax.

The Bathtub Lounge Chair in patent Des335,036 to Simmons, 1993 Apr. 27, is an ornamental design lounge chair mainly for basically sitting in the bathtub, with no actual support to the bather or providing any degree of comfort.

The Tub Comforter in U.S. Pat. No. 4,574,406 to Sutton and Spector, 1986 Mar. 11, may provide some degree of comfort by allowing the bather to lean back and take discomfort off the lower back. The user may find some relief as it allows one to lean back. The supports may allow the user to rest. Consequently, the bather can not obtain true comfort and support. Also, the cost of producing this product would be quite expensive with gears for adjustments.

The Tub Seat Massager in U.S. Pat. No. 4,780,916 to Sutton, 1988 Nov. 1, is constructed to massage the user while bathing. The pressurized air openings allow the water to massage the entire body. The contoured seat with headrest allows the user to recline and achieve only some degree of comfort. While this may be some comfort to the user the actual comfort cannot be achieved by the overall construction of this product. This massaging seat is complicated in structure and may be expensive to manufacture.

The Reclining Board with an Adjustable Stand for use in a Baby Bathtub in U.S. Pat. No. 5,297,300 to Sheu, 1994 Mar. 29, this device is used strictly for bathing of infants. The disadvantage of the listed prior art is that all attempt to support and provide comfort to the bather. However, the existing designs do not allow the bather to actually relax and give support to the body. There is a great need for the bather to find total comfort and total support of the body while taking a bath. This need will allow the bather to actually achieve relaxation of the body.

OBJECTS AND ADVANTAGES

Accordingly, several objects and advantages of my bathtub insert are:

(a) to provide the user with a design that adheres to the human body form;

(b) to provide the user with support to each part of the body from the head, neck, back, arms, legs, and feet;

(c) to provide the user with support to the spinal column to produce essential relaxing benefits;

(d) to provide the user with a soft, full support contour design for absolute comfort;

(e) to provide a simple method of design for total comfort and support for the user;

(f) to provide a lightweight, efficient, easy to use product;

(g) to provide a product that conforms to the shape of the bathtub to allow the user to have proper support and comfort for the body; and Further objects and advantages are to provide the user with a safe, easy, and accommodating method of use. To provide a product that is anti-bacterial, chemical, mold, mildew resistant for easiest cleaning. Also, provides an easy method of securing product in the bathtub for maximum safety while in use. Still further objects and advantages will become apparent from a consideration of the ensuing description and drawings.

SUMMARY

In accordance with the present invention a bathtub insert titled "Take Five" comprises the combination of two designs: a top contour design and a bottom contour design. The top contour design will conform to the shape of the human body for total support. The bottom contour design will conform to the shape of the standard bathtub and give vital support to the top contour design. The bottom contour design will supply the entrance and exit area.

DRAWINGS

Figures

The preferred embodiments of the bathtub insert "Take five" are illustrated in the drawings, wherein.

DRAWINGS

Reference Numerals

| | |
|---|---|
| 20 head adjustment | 22 headrest |
| 24 cervical spine rest | 26 thoracic spine rest |
| 28 lumbar spine rest | 30 hip rest |
| 32 thigh support | 34 knee support |
| 36 calf support | 38 ankle support |
| 40 foot rest | 42 upper arm rest |
| 44 forearm rest | 46 hand rest |
| 48L/48R impression folds | 50 base support |
| 51A/51B pedestal support | 52 in/out platform |
| 54L/54R placement/removal straps | 56L/56R suction cups |
| 58A/58B hanger straps | 60 top contour design |
| 62 bottom contour design | 64 durable vinyl |
| 66 non-porous foam | 68 visco-elastic foam |
| 70 polyurethane foam | 72 bathtub surface |
| 74 leg strap | 76 standard tub |
| 78 tub water drain | 80 anti-skid block |
| 82 anti-skid vinyl | 83 whirlpool bath |
| 84 systematized massage jets | 86 control panel with timer |
| 88 fiberglass base | 90 flush circular sealer |
| 92 air chamber | 94 durable plastic tubing |
| 96 clamp | 98 pump/motor |
| 100 durable plastic pipe | 102 support brackets |
| 104 electrical cord | 106 bolts, nuts, screws |
| 108 mounting plate | 110 water suction inlet |
| 112 smooth top design | 114 accessory compartment |
| 116 timer | 118 outlet |
| 120 phantom lines | 122 cup holder |

DETAIL DESCRIPTION

FIGS. 1-7, FIGS. 11, 12, 14-17 Preferred Embodiment

Figure 1:
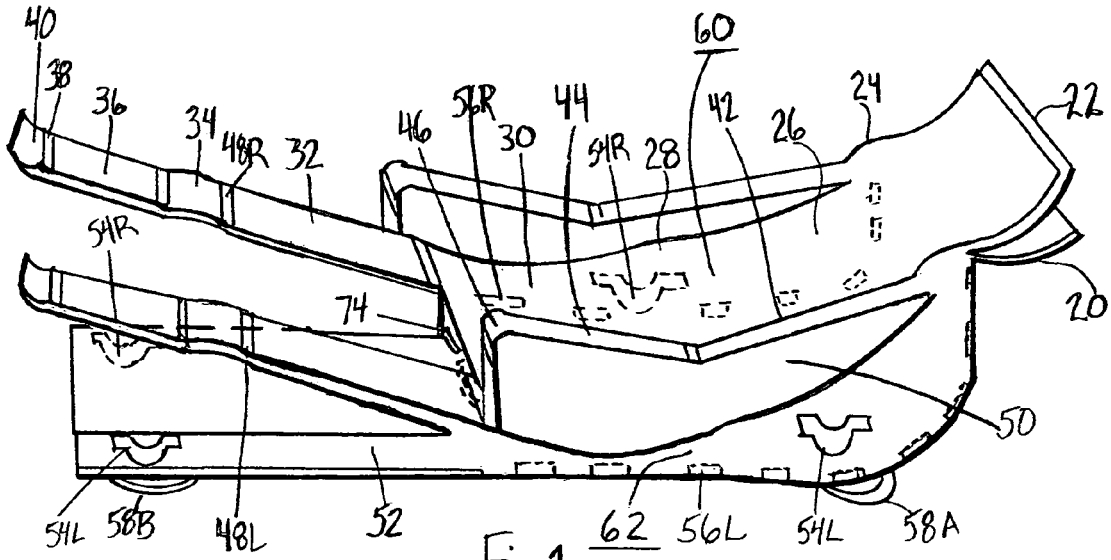
FIG. 1 shows a perspective view of the preferred embodiment of the bathtub insert.

Refer to FIG. 1 Illustrates a perspective view of the preferred embodiment of my bathtub insert "Take Five". The detail description of my bathtub insert is the following. My bathtub insert will be made from a pattern. The pattern will be drawn by computer aided drafting and design. The pattern will then be cut to form by specialized skill saws. The specialized skill saws are designed to cut foam products. The pattern design may also be formed by templates. The templates will then be placed on foam then cut by specialized skill saws.

The preferred embodiment is shown in a rectangular shape. This will be the first section, a top contour design 60. Design 60 will be made from a recognized foam material by TEMPUR-PEDIC. For example, design 60 will be made from a visco-elastic foam 68. Design 60 will be approximately 4 cm to 5 cm in thickness. Design 60 will be approximately 121 cm in length. Design 60 will be approximately 50 cm to 55 cm in width. The measurements will vary in accordance with a standard tub 76 sizes. The measurements will vary with individual statues. Foam 68 will permit design 60 to contour to the human body form.

Foam 68 will be constructed to form convention convex design pieces (not shown). The conventional convex design pieces used for lumbar support. The lumbar support used in most chairs, seats, and in cars. The conventional convex design pieces used as placement inserts on chairs, seats, and in cars. Foam 68 will conform to the body in the following rests and supports. In the concave shape a head rest 22; in convex shape a cervical spine rest 24, or neck support; in concave shape a thoracic spine rest 26, or upper back support; in convex shape a lumbar spine rest 28, or lower back support; and in concave shape a hip rest 30, or seat support.

The conventional convex designed pieces will be made of two variations: one, foam 68, and two, a polyurethane foam 70 will be placed for added comfort and support. Foams 68 or 70 will angle from less than 0.25 cm and ascend gradually. Foams 68 or 70 will ascend and increase approximately 2 cm to 6 cm in thickness. Foams 68 or 70 will descend gradually to approximately 0.25 cm in thickness. Foams 68 or 70 will be approximately 50 cm to 55 cm in length. Foams 68 or 70 will be positioned beneath foam 68 and glued at these exact locations rest 24 and rest 28 on design 60. Rests 24 and 28 will be constructed integrally or separately then glued.

Extending parallel from rest 26, or upper back support and rest 28, or lower back support to rest 30 will be a base support 50. Support 50 will provide support for a upper arm rest 42, or arm rest; a forearm rest 44, or arm rest; and a hand rest 46, or hand rest. Support 50 will be constructed of foam 70. Rests 42, 44, and 46 will be constructed from foam 68. Support 50 and rests 42, 44, and 46 will range approximately 4 cm to 10 cm then increase to 21 cm in height. Support 50 will vary in width from approximately 8 cm to 12 cm. Rests 46 will have a convex portion of foams 68 or 70. Thickness of the convex portion of rest 46 will be ascending approximately 0.25 cm to 3 cm to 6 cm in thickness. Then descending from approximately 6 cm in thickness to 0.25 cm. Support 50 will be constructed integrally or separately in various angles and positions then glued to design 60. Support 50 will be aligned flush and placed on left and right sides of design 60.

Also, extending parallel from rest 30, or seat support will be a thigh support 32, or leg support; a knee support 34, or leg support; a calf support 36, or leg support; a ankle support 38, or leg support; and a foot rest 40, or foot rest. Supports 32, 34, 36, 38, and rest 40 will be in an upright angled position aligned flush and placed on left and right sides of rest 30 to end of and beyond tub 76. Supports 32, 34, 36, 38, and rest 40 will be approximately 4 cm to 5 cm in thickness consisting of foam 68. Supports 32, 34, 36, 38, and rest 40 will be approximately 18 cm to 25 cm in width. Supports 32, 34, 36, 38, and rest 40 will also vary in thickness and lengths. Lengths, widths, angles and positions will vary to accommodate individual statues. Supports 34 and 38 will have an additional convex portion of foams 68 or 70. Convex portions will vary in thickness and widths accordingly with individual statues. Also, an additional view shown in FIG. 12.

Figure 6:
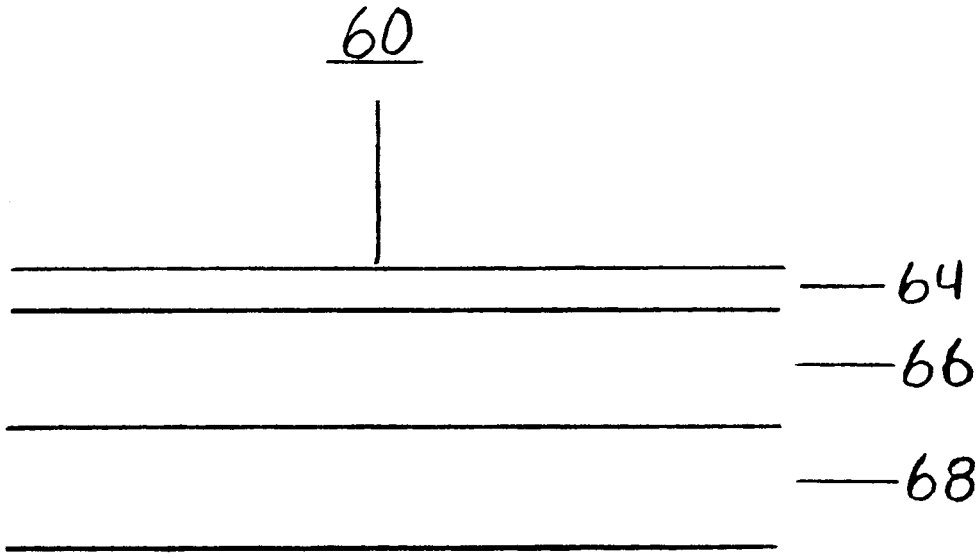
FIG. 6 illustrates cross-section view of top contour design.

Refer to FIG. 6 Cross-Section This cross-section illustrates material used for design 60. The outer layer of design 60 will consist of a durable vinyl 64. Vinyl 64 will be approximately 30 mm in thickness. Vinyl 64 will be glued to a non-porous foam 66. Then sealed in a process that will permanently bond the two materials together. The sealing process can also be done by a welding process. First layer will be made with foam 66. Foam 66 will be approximately 1 cm to 1.5 cm in thickness. The second layer will consist of foam 68. Foam 68 will be approximately 4 cm to 5 cm in thickness.

Figure 3:
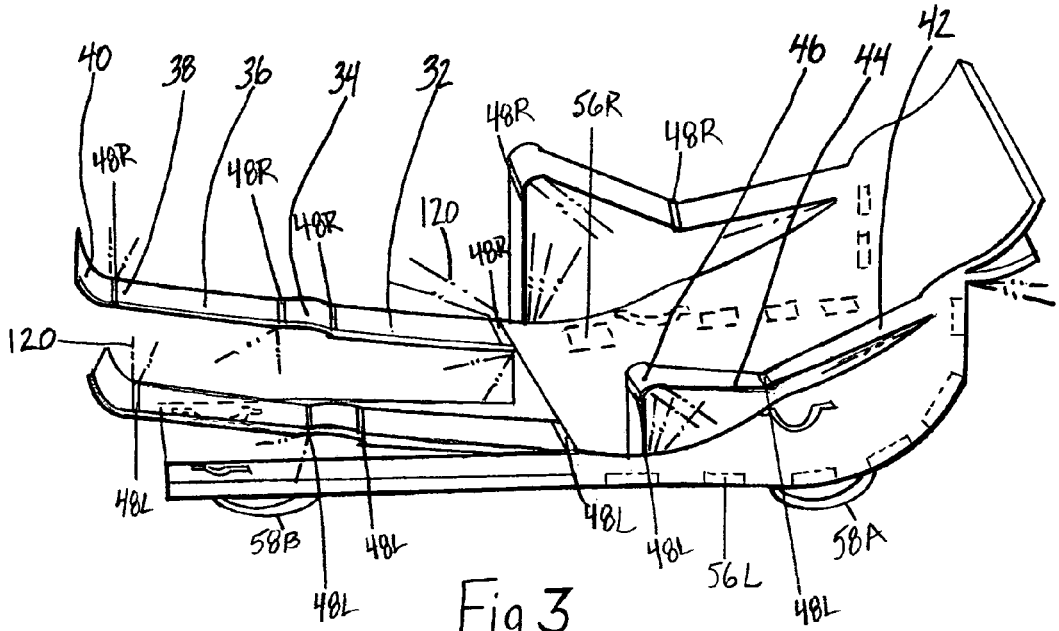
FIG. 3 shows a perspective view of the bathtub insert in phantom alternate position.

Refer to FIG. 3 Illustrates a impression folds 48L/48R will be positioned in certain areas of the insert. They are designed with rest and supports 32, 34, 36, 38, 40, 42, 44, and 46. Folds 48L/48R will be designed integrally as a seam or impression in a pressed method of construction. Illustrated in secondary positions in a phantom lines 120. Included for convenience the insert will have connecting straps as to conventional bungee cords (not shown). The connecting straps can also be made to the likeness of conventional nylon straps on tote bags and luggage (not shown).

Figure 15:
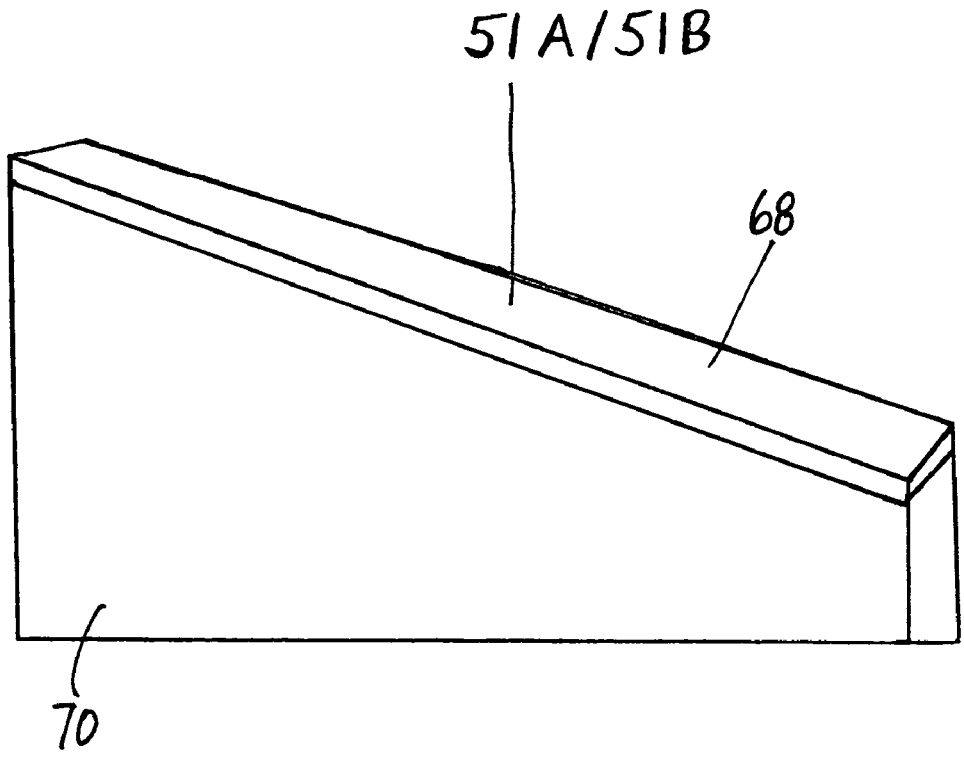
FIG. 15 shows view of pedestal support.

Supports 32 through 38 will be constructed by two methods. First method: as shown in FIG. 3, which is shown as a self-support structure, and described in FIG. 1. Materials used such as thin lightweight, flexible, non-corrosive metals or plastic used in conventional items. Examples of conventional items such as purses, and all types of carry tote ensembles and attaché cases, etc (not shown). The lightweight metal or plastic will be placed on the bottom side of supports 32 through 38. Foam 68 will be placed on top of metal or plastic for adhesion and bonding. Supports 32 through 38 will then be encapsulated with foam 66 and vinyl 64. Supports 32 through 38 will be constructed integrally or separately from the insert. Second method: Refer to FIG. 15 The second preferred method which is a pedestal support 51A/51B. Support 51A/51B will be placed at and extend from rest 30 and further extending to rest 40. Support 51A/51B will be constructed of foam 70. Support 51A/51B will vary in various angles, heights and lengths, will measure approximately 4 cm to 32 cm in height. Tapering to approximately 20 cm to 10 cm in thickness. Support 51A/51B will have an upper layer of foam 68 that will provide maximum comfort. Foam 68 will vary in thickness of 1 cm to 3 cm. Support 51A/51B can be made integrally or separately from the insert. Variations will be provided for use of numerous individual statures, from children to adults. This triangular wedged shape will have the versatility of placement and removal from the insert.

Figure 16:
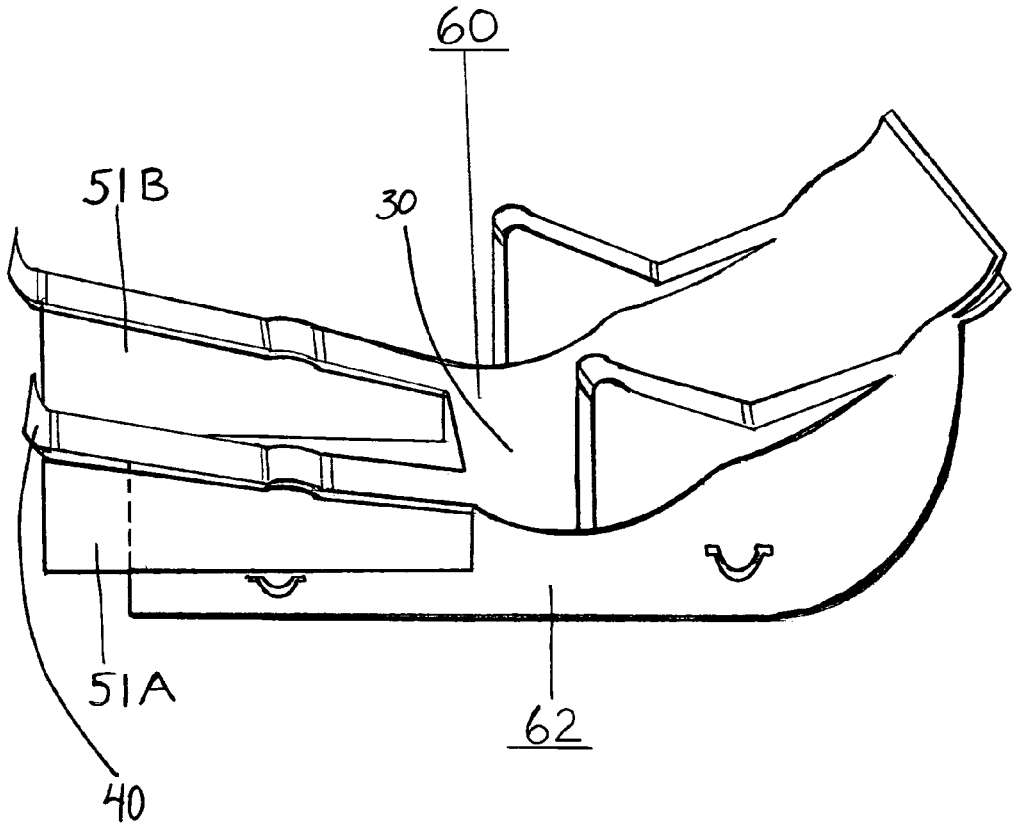
FIG. 16 illustrates preferred embodiments with pedestal supports.

Refer to FIG. 16 Support 51A/51B may also be constructed integrally or separately with the bathtub insert. Support 51A/51B will also be constructed individually for various statue individuals. Placement of support 51A/51B will begin at rest 30 and extend forward to rest 40.

Figure 2:
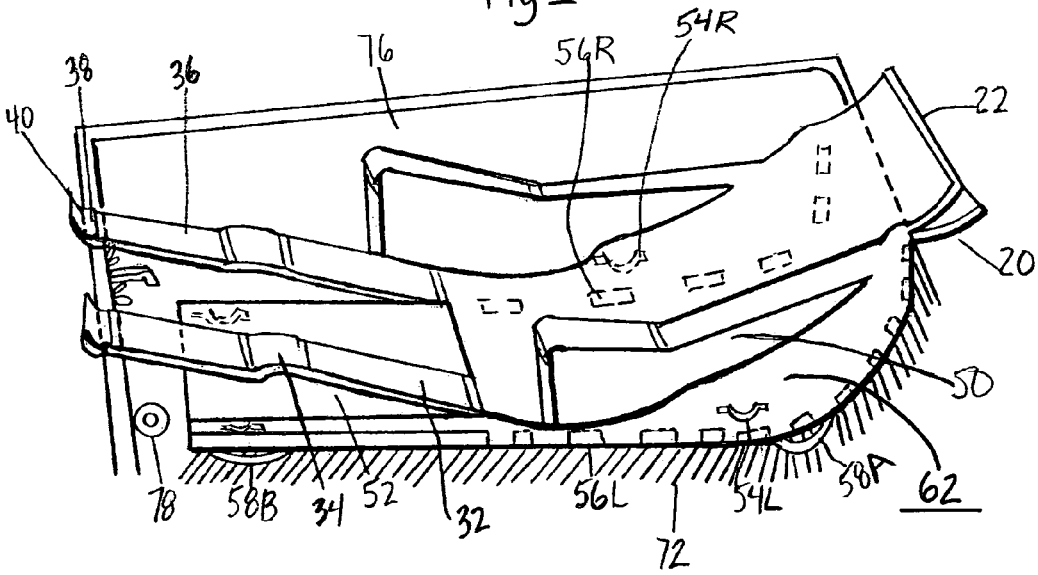
FIG. 2 shows a perspective view of the preferred embodiment in the bathtub.

Refer to FIG. 2 Illustrates a perspective view of the bathtub insert "Take Five". The preferred embodiment is shown in an angled curvature shape. This will be the seconded section, a bottom contour design 62. This will allow the insert to conform precisely to shape of tub 76. Design 62 will be constructed of foam 70. Design 62 will begin approximately 1 cm to 1.5 cm upper edge projection. Design 62 will then taper to a thickness of approximately 7 cm to 8 cm in an angle curvature. With continued angled tapering to approximately 10 cm to 12 cm in thickness to curvature of tub 76. Then tapering approximately 2 cm to 5 cm thickness to a tub water drain 78. Length of design 62 will be approximately 139 cm, but will vary accordingly with size of tub 76. Foam 70 will create an upper edge projection. This projection of the angled curvature shape will be a head adjustment 20. The angled curvature shape would then extend along bottom of a bathtub surface 72 approximately 5 cm from drain 78.

Figure 14:
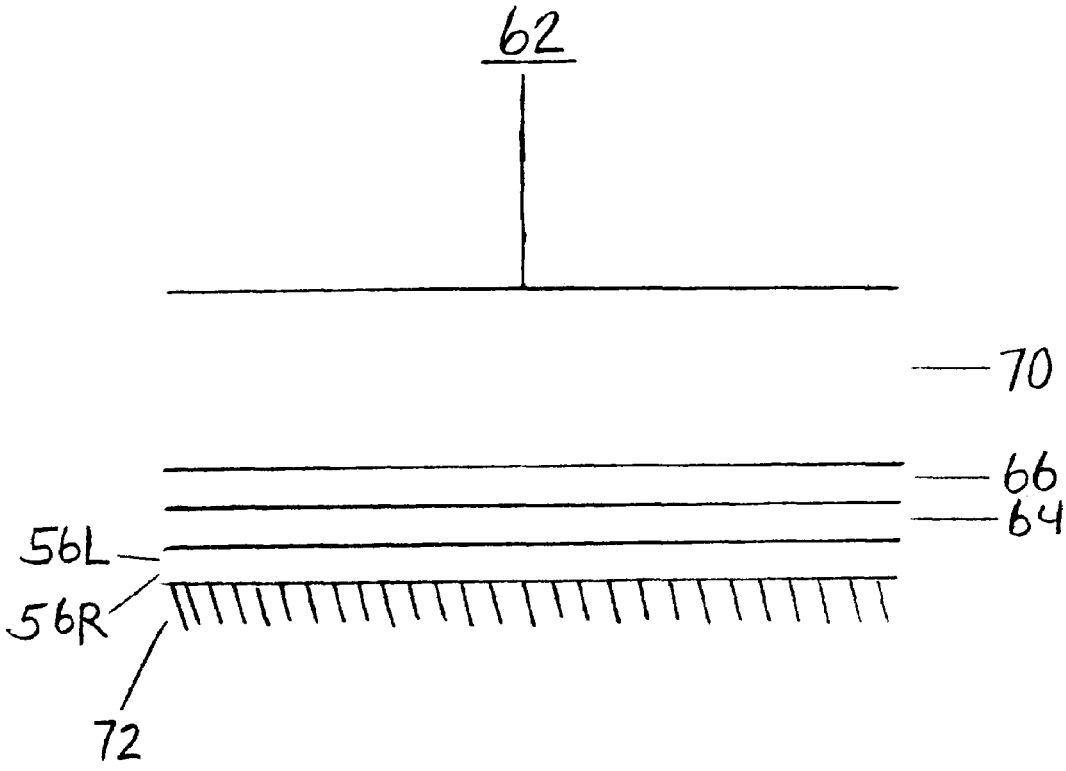
FIG. 14 illustrates a cross-section view of bottom contour design.

Refer to FIG. 14 Cross-Section The cross-section illustrates material used for design 62. The first layer will be made of foam 70. The second layer will be made of foam 66. The third outer layer will be made of vinyl 64. The outer layer will contain a suction cups 56L/56R to adhere to surface 72.

Figure 17:
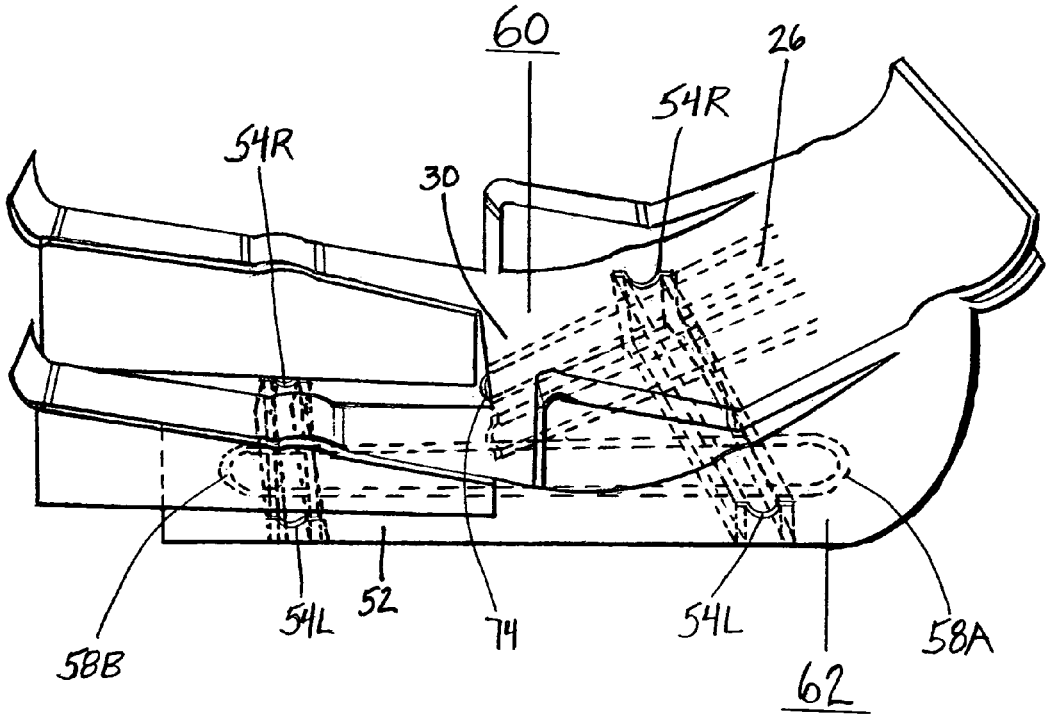
FIG. 17 shows an additional view of my bathtub insert.

Refer to FIG. 17 Illustrates positions and locations of a leg straps 74, a placement/removal straps 54L/54R, and a hanger straps 58A/58B. Straps 74, 53L/54R, and 58A/58B will be positioned on and between designs 60 and 62. Provided and positioned starting at rest 30 and extending to rest 26 will be strap 74. Strap 74 will be glued between designs 60 and 62. Provided and positioned on opposite ends and both sides design 62 will be strap 54L and 54R. Provided and positioned on bottom of design 62 will be strap 58A and 58B.

The outer lining of straps 74, 54L/54R, and 58A/58B will consist of vinyl 64. The inner lining of straps 74, 54L/54R, and 58A/58B will be made of conventional durable nylon. The conventional nylon material used on book bags and luggage made today (not shown). Strap 74, will be positioned and glued vertically from bottom end of design 60 starting at rest 30 extending to rest 26. Strap 74 will be approximately 1.5 cm to 3 cm in width. Strap 74 will measure from rest 30 to form an approximate 12 cm to 15 cm loop. Strap 74 will continue from rest 30 and extend vertical length of 46 cm to rest 26. Then positioned before and between gluing of design 60 and design 62.

Strap 54L/54R will be positioned and glued horizontally, full width, between design 60 and design 62. Strap 54L/54R will be positioned and glued horizontally, full width between rests 24 and 28. Strap 54L/54R will be draped along bottom side of design 62 and top side of design 60. Then continue to meet at juncture and joined together between design 60 and 62. Strap 54L/54R will be sewn together in a bridle type effect. The bridle type effect will be made to form a loop. This will allow strap 54L/54R to slip over top end of design 62. Strap 54L/54R will be positioned for adhesion between design 60 and design 62. Strap 54L/54R will also be positioned and bonded with a glue adhesive horizontally on a in/out platform 52. Strap 54L/54R will be positioned in area beneath rest 30 and middle of platform 52.

Strap 58A/58B will be positioned and bonded with a glue adhesive vertically on bottom of each end of design 62. Strap 58A/58B will be positioned and bonded with glue adhesive prior to placement of cups 56L/56R. The insert package will include a conventional hanger (not shown). The insert will be made with a conventional air vent (not shown). The vent will be cut in a flat pocket style on the insert. The vent will be incorporated and made into vinyl 64. The vent will be incorporated within design 60 or 62. In addition, the insert package will include connecting strap 58A/58B. The connecting straps will be designed from materials to the likeness of conventional bungee cords (not shown). The combination of these materials will ensure a stronger more durable strap for all locations within the insert. Vinyl 64 and conventional nylon (not shown) will also provide a tear, mold and mildew resistant combination.

Figure 4:
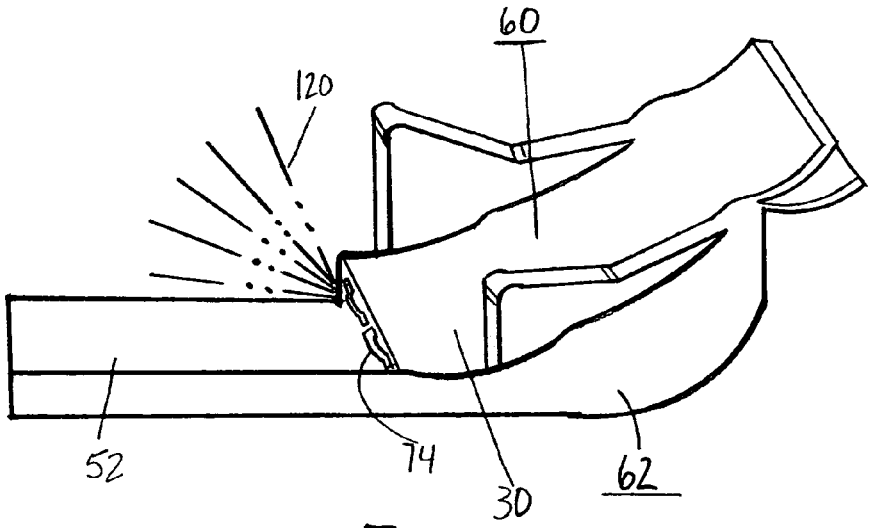
FIG. 4 shows an enlarged perspective view of the secondary position.

Refer to FIG. 4 Illustrates alternate positions for folding shown in lines 120 without supports 32, 34, 36, 38, and 40 for viewing of strap 74. Also illustrates platform 52 for further description. Platform 52 will be included as part of extended portion of design 62. Platform 52 will be constructed with a grid-like design effect. The grid-like design that is used to make conventional plastic crates (not shown). Also, platform 52 can be constructed as a anti-skid block 80. Top and bottom layers of block 80 will be encased in a anti-skid vinyl 82. Middle layer can be constructed of conventional plastic (not shown) or sturdy foam.

Figure 5:
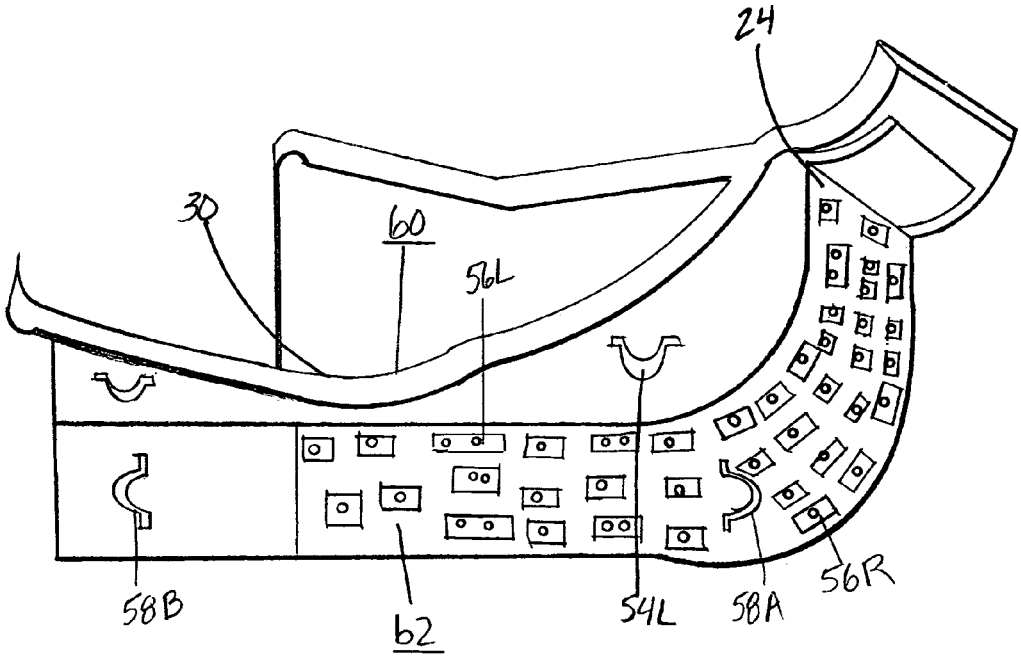
FIG. 5 shows a backside view of the bathtub insert.
Figure 7:
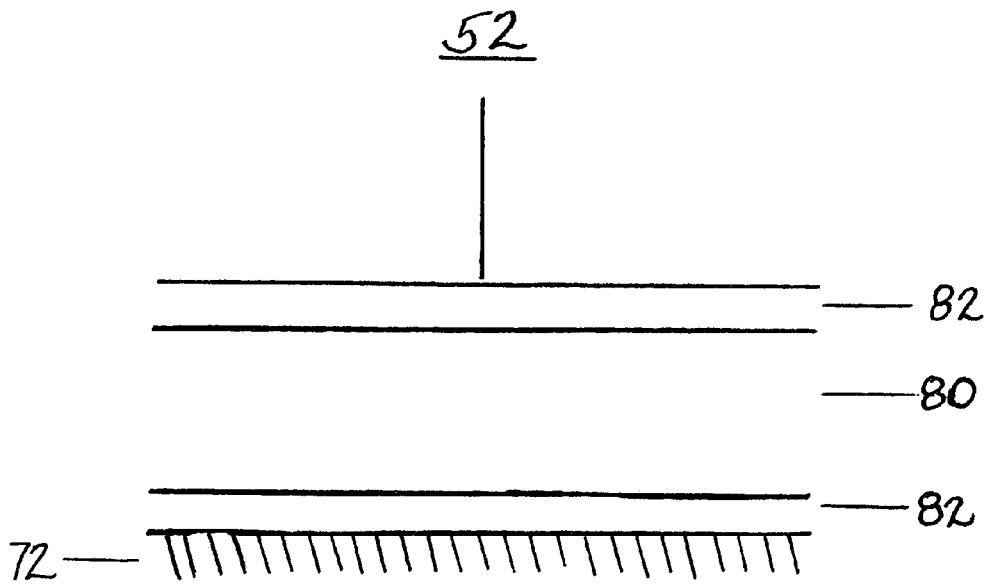
FIG. 7 illustrates a cross-section view the in/out platform.

Focus on enlarged cross-section view of FIG. 7 to further illustrate. This cross-section illustrates materials used for platform 52. The outer layer of platform 52 will be made from vinyl 82. Vinyl 82 will be approximately 30 mm to 40 mm in thickness. The inner layer of block 80 will be made of solid durable plastic as used conventional crates (not shown). Block 80 will vary in thickness of 2 cm to 4 cm. The outer layer or bottom layer will be vinyl 82. Also, illustration is shown with surface 72. Refer to FIG. 5 Illustrates a backside view of my bathtub insert. Cups 56L/56R will be made to form with design 62 in multiple rows. Cups 56L/56R will be small in size and placement will begin at rest 24 continuing onward to rest 30. Cups 56L/56R will be made as to the width and length of the insert. Specifically from width and length of rest 24 continuing onward to rest 30. Cups 56L/56R will be designed as those used on conventional bath mats (not shown). Cups 56L/56R will be integrally constructed within a rubberized mat with approximate thickness of 1 mm to 1.5 mm. Cups 56L/56R will then be glued, sealed and/or bonded to bottom of design 62.

Figure 11:
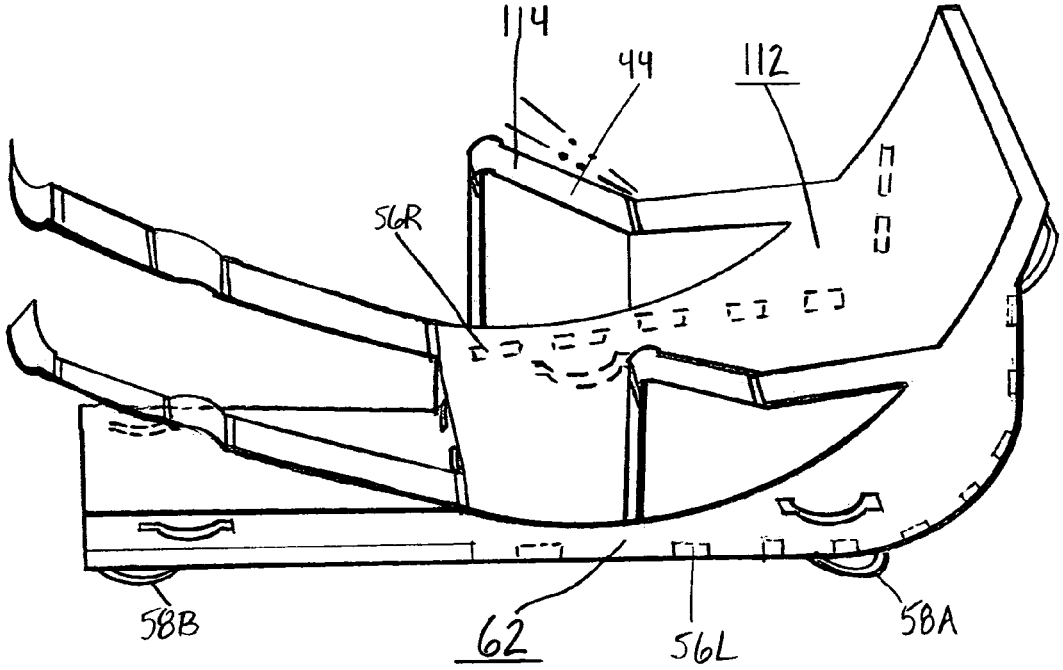
FIG. 11 shows an alternate preferred embodiment of the insert.

Refer to FIG. 11 The preferred method for manufacture will be foam 68 that conforms to the shape. Illustration is shown without placement of conventional convex design pieces (not shown). The conventional convex design pieces used for lumbar support in most chairs, seats and in cars. The conventional convex design pieces used also as placement inserts on chairs, seats and in cars. Foam 68 has a smooth top design 112 that contours to the body when pressure is applied. The preferred materials will be high density foams and durable vinyl. The insert will consist of materials constructed from vinyl 64, foam 66, foam 68, and foam 70. Further including, design 60 and design 62 will be bonded with glue adhesive and encapsulated with materials listed above.

The insert can also be made by a mold injection process. The injection process will allow foams 66, 68, and 70 to create design 60. The mold will be made to shape to the human body form. The injection process will consist of a mold that will be filled with option of foams 66, 68, and 70. The mold will be made to conform to design 62. The mold will be made to shape of tub 76. In addition, the insert can be constructed of foams 66, 68, and 70 in combination with a conventional gel textured layer. The conventional gel texture that is used in foot insoles (not shown). This gel textured layer can be added for additional comfort. The get textured layer can be placed on top or beneath foams 66, 68, and 70. The insert will be encompassed with vinyl 64. Material listed above will be bonded with glue adhesive and encapsulated.

The insert can also be made form a mold and formed to shape by a vacuum process. This vacuum process will consist of foams 66, 68, and 70. The insert will be encompassed with vinyl 64. The insert can also be made from conventional durable plastics (not shown). The plastic will then be placed in mold and form to shape by the vacuum process. The plastic will be an anti-skid plastic or vinyl. Designs 60 and 62 will be encapsulated with or without foams 66, 68, and 70. The insert will be encompassed with or without vinyl 64.

Figure 12:
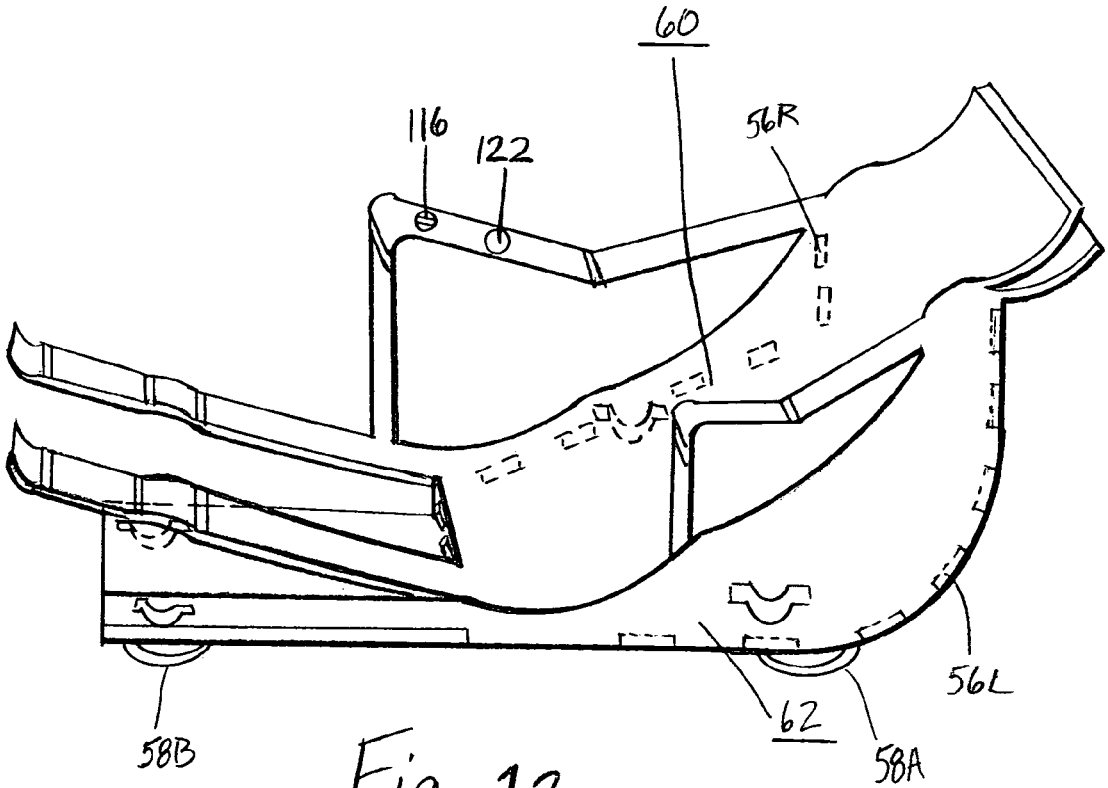
FIG. 12 shows additional view of preferred embodiment.

FIGS. 11 and 12

Additional Embodiments

Additional embodiments are shown that can be implemented to the preferred embodiment of my bathtub insert. FIG. 11 shows a accessory compartment 114. Compartment 114 will be constructed as a rectangle square shaped pocket within base 50. Rest 46 and supports 44 will be made to open and close with folds 48L/48R. Compartment 114 can be constructed with conventional hinges and clasps to open and close. The conventional hinges and clasps used on glove compartments, boxes, and cases used today. FIG. 12 shows a timer 116 that will be an added feature to the preferred embodiment. Timer 116 will be constructed within base 50. Timer 116 will be constructed as conventional clock timers. The conventional timer used on whirlpool baths and spas. FIG. 12 also illustrates a cup holder 122. Holder 122 will be constructed with base 50. Holder 122 will be constructed as conventional cup holders on chairs, whirlpool baths, spas, and in cars.

Operation

FIGS. 1-5, FIG. 11, 12, and FIGS. 15-17
Cross-Section FIGS. 6, 7, and 14

The following manner of operation is to give an account of the preferred embodiment of my bathtub insert. The insert is designed for simplicity and convenience to the user. Referring to FIGS. 1-5, 11, 12, and FIGS. 15-17 The insert would be placed into the bottom of tub 76 by straps 54L/54R positioned opposite bathtub faucet. This will be accommodating depending upon which end the bath faucet may be positioned. The convenience of strap 54L/54R are necessary for the user. Strap 54L/54R will be used to assist the user when getting in and out of tub 76. The first section of insert design 60 with rest 22 in conjunction with adjustment 20 will be positioned against tub 76 and the bath wall. Rest 22 and adjustment 20 provide the user with this valuable asset for proper placement of the head and neck. With the proper placement platform 52, which extends from design 62 will not block drain 78. Platform 52 is provided for safe entry and exit from the insert while placed in tub 76. At this point, the user presses on the insert either by use of hands or sitting on the insert for secure adherence to surface 72 by cups 56L/65R. This procedure should and must be done prior to adding water for bath. Design 62 is constructed to provide crucial and vital support to design 60.

Sitting upon the insert, places the user in an upright angled position that conforms to the curvature of the body. Once user sits on the insert immediate recognition of total body support will be found. This discovery would consist of rests 22 through 30. Rests 22 through 30 will provide vital natural support and comfort to the head, neck, and back. In addition to the total support of the body the user then discovers rests 42 through 46. Rests 42 through 46 will give comfortable support to the arms and hands. After this, the user then realizes that supports 32 through 38, and rest 40 give desired leg and foot support.

In addition, the user will be provided with support 51A/51B that gives vital support to leg and foot supports. Support 51A/51B will be an alternative method of leg support of my bathtub insert. The user will be provided with convenient strap 74 for packing purposes for supports 32 through 38 and rest 40. Also, for convenience of use strap 58A/58B. Strap 58A/58B will be provided for drip-drying and hanging purposes before and after use. After use the insert will be placed on conventional hanger (not shown) for drying. The insert package will provide the hanger. The user will open conventional air vent (not shown) for ventilation of foams 66, 68, and 70. The conventional air vent will supply air to foams 66, 68, and 70 after use. The vent will be provided to restore resilience to foams 66, 68, and 70 after use.

Also, provided for convenience of use for the insert will be folds 48L/48R. Folds 48L/48R that will serve as folding seams for packing purposes. In addition, the insert will have straps as to conventional bungee cords (not shown). The connecting straps can also be made to the likeness of conventional nylon straps on tote bags and luggage (not shown). The connecting straps will serve as the joining link for strap 58A/58B for folding and packing purposes. At this precise moment the user then comprehends, finally, that total relaxation and full body support can be achieved while bathing and/or soaking in tub 76.

Referring to FIG. 6 Cross-Section The outer layer of design 60 will consist of vinyl 64. Vinyl 64 will provide safety and comfort for the user. Vinyl 64 will also provide an anti-bacterial anti-skid surface, which will be chemical, mold, mildew, and puncture resistant. Vinyl 64 will be used to encapsulate the insert to assure a non-slippery surface. The first layer made with foam 66, will be used to prevent water absorption and reduce bacteria. The second layer made with foam 68, will be made thick enough to support and conform to the entire body. Foam 68 will prove vital to imitate the curvature of the human body form. Foam 66 and vinyl 64, will be used to fully prevent water absorption and to reduce bacteria in supports 32 through 38, and rest 40. Foam 66 and vinyl 64 will encompass supports 32 through 38, and rest 40 as they are not constructed as united sections of design 60 and design 62.

FIG. 7 Cross-Section The first outer layer of platform 52 will consist of vinyl 82. Vinyl 82 will be use for maximum safety for the user. Block 80 will serve as platform 52. For this purpose, it will allow the user adequate space for an entrance and exit area. The second outer layer of block 80 will consist of vinyl 82, for this purpose it will adhere to surface 72 for maximum safety measures.

Referring to FIG. 11 Shows compartment 114 that can be an additional convenience to the user for item storage.

Referring to FIG. 12 Shows timer 116 that can be an added feature to the insert for the user. This feature will be needed to wake the user that is experiencing ultimate relaxation for the first time. Also, illustrates holder 122 for additional convenience to the user for beverages.

Referring to FIG. 14 Cross-Section The first layer of design 62 will consist of foam 70. Quality high density foam 70 will provide vital and adequate support to design 60. The second layer foam 66 will then follow to prevent water absorption and reduce bacteria. The third layer will consist of vinyl 64 to assure a non-slip resistance against surface 72. Cups 56L/56R will also provide adherence to surface 72 for a non-slip resistance.

FIGS. 8, 9, 10 and 13

Alternate Embodiments

Figure 8:
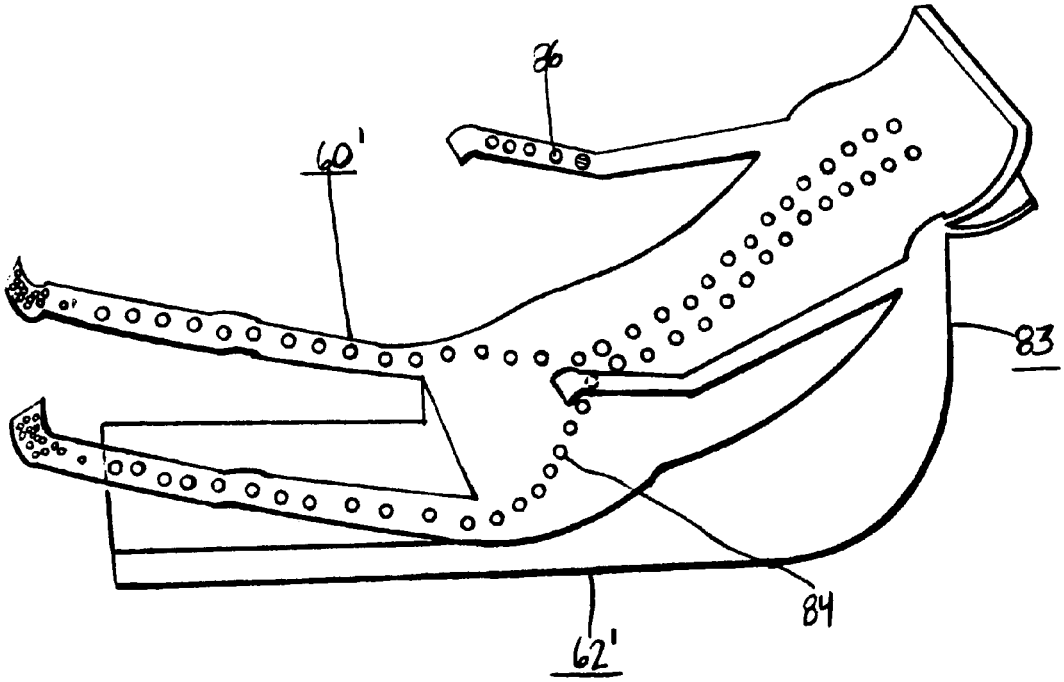
FIG. 8 shows an alternative embodiment.
Figure 9:
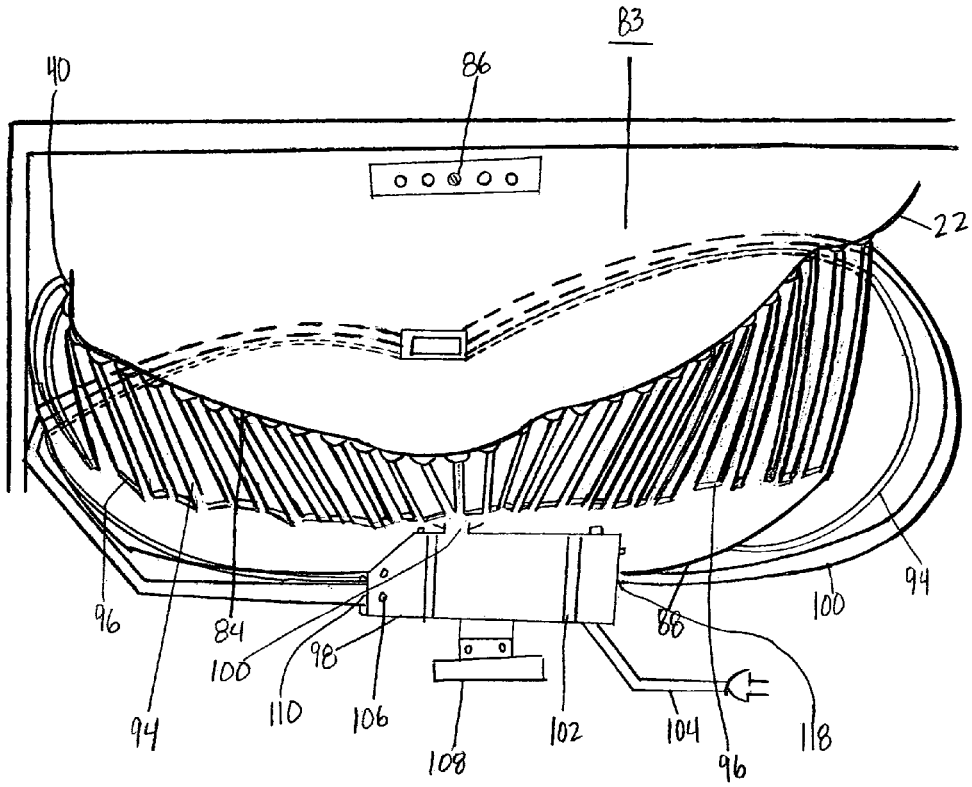
FIG. 9 shows side view of alternative embodiment.
Figure 10:
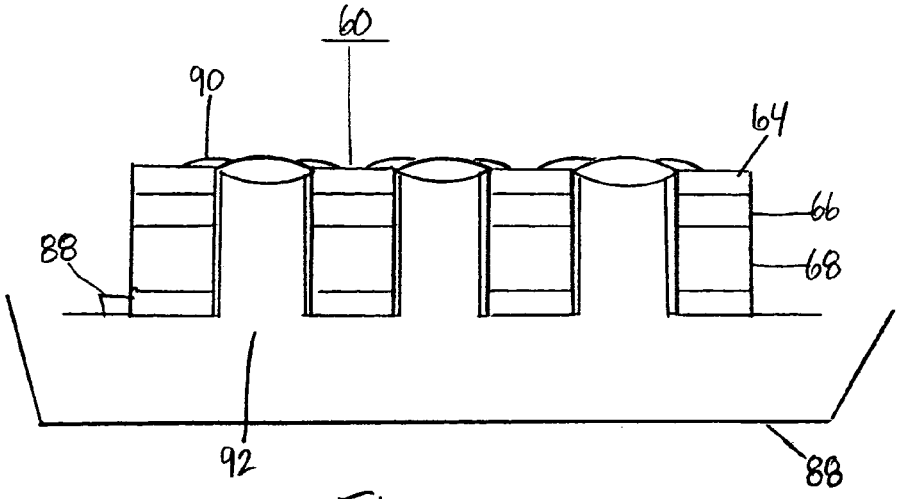
FIG. 10 illustrates cross-section view of alternative embodiment.
Figure 13:
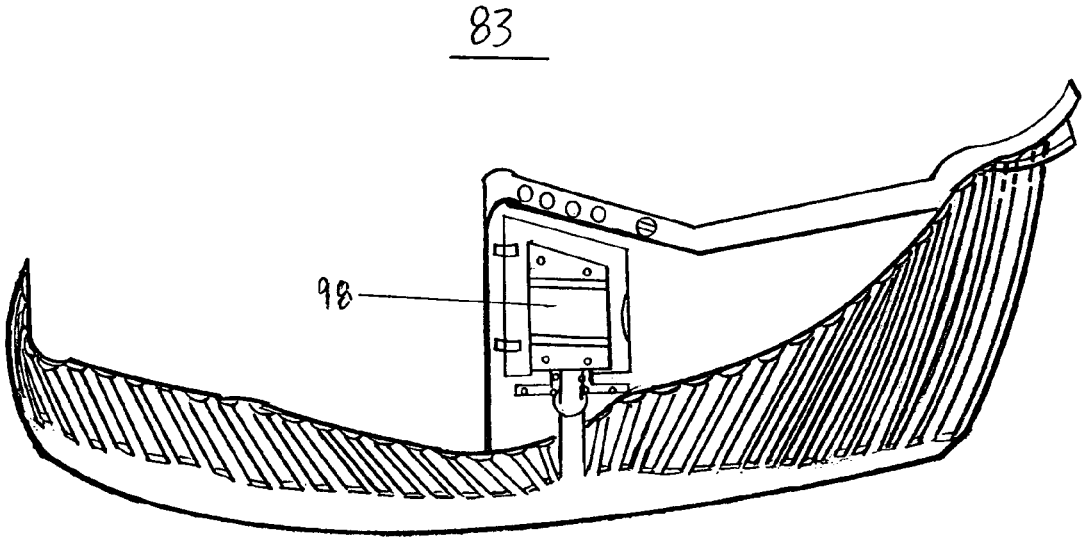
FIG. 13 shows view of alternate view of preferred embodiment.

Description FIGS. 8, 9, and 13 Enlarged View FIG. 10

Refer to FIG. 8 The insert is shown as a whirlpool bath 83 for tub 76 (not shown). This alternate preferred embodiment will be made from conventional materials for bathtubs and replacement tubs (not shown). The alternate preferred embodiment will be made from materials that provide anti-bacterial protection. Additionally, the alternate embodiment will be made from materials that will seal and bond. The material used will seal and bond the acrylic or other various materials used in conventional tubs (not shown). Bath 83 may also be constructed with the additional conventional materials for maximum comfort to the user (not shown). The drawing is shown with design 60, and design 62, featuring a systematized massage jets 84, a control panel with timer 86. Timer 86 can be constructed on or near arm rest. Timer 86 can also be constructed integrally within bath 83. The drawing illustrates design 62, which will not be part of construction process.

Refer to FIG. 9 Illustrates one side of jets 84 made of a durable plastic tubing 94 for proper airflow. Jets 84 are made as to conventional jets in whirlpool baths (not shown). Attached to jets 84, will be tubing 94, then, attached in a proximal strategic manner to a durable plastic pipe 100. Pipe 100 will be secured by a clamp 96 or by the most advanced method. Jets 84 will be placed in proximal location to the body. The proximal location will then disperse from the base of rest 22 to rest 40. Jets 84 will be placed on right and left sides of the spinal column. Branching from the rest 30, descending down supports 32 through 38 will be multiple small jets 84 for the ultimate foot massage located at rest 40. Jets 84 can be positioned in dual or multiple rows conforming to the spinal column. Jets 84 can be positioned in dual or multiple rows beneath the legs. This revolutionary massage design will be made by conventional molds (not shown) for proximal location to the spinal column. Tubing 94 will then be sealed to bath 83. Jets 84 will then be attached to bath 83. Attached to a fiberglass base 88 will be a pump/motor 98 connected to pipe 100. Motor 98 will be an electric motor with propellers, ground wires, hot wire and any additional necessary parts cased within. Motor 98 will then be mounted by a support bracket 102, a electrical cord 104, a bolts, nuts, and screws 106. Also, motor 98 will be placed on a mounting plate 108 that will reduce noise and vibration levels. Tubing 94 will be connected to motor 98. Tubing 94, pipe 100 will be attached to motor 98. In addition, tubing 94, pipe 100 will be attached to a water suction inlet 110. Timer 86 for operation of bath 83 will be attached to inlet 110 and a outlet 118. Tub 83 will be offered not only as future whirlpool tubs for new homes and remodeling purposes, additionally, it will be offered as replacement baths in existing homes. Tub 83 can also be incorporated into the future design of conventional hot tubs (not shown).

Refer to FIG. 10 Illustrates cross-section construction description of alternate preferred embodiment. This design will provide maximum comfort to the user in FIGS. 8, 9, and 13. The cross-section construction view of design 60, consist of the following materials. A flush circular sealer 90 will serve added comfort to the user. Also, sealer 90 will provide a water resistant conjunction between design 60, and a air chamber 92. Sealer 90 will consist of materials such as vinyl 64 or conventional durable plastic material (not shown). Sealer 90 is permanently placed and bonded with a solvent adhesive or made integrally. Vinyl 64, foam 66, foam 68, and base 88 can be used for maximum comfort or by advanced technology methods. Also, use of various existing conventional materials that provide comfort and safety for conventional hot tubs (not shown).

Refer FIG. 13 Illustrates alternate position of motor 98.

Additionally, the alternative embodiment will have all the necessary and luxury features as provided by conventional whirlpool baths and spas (not shown).

Operational FIGS. 8, 9, and 13

Referring FIGS. 8 and 9 Illustrates strategic placement of jets 84 in proximal location to the spinal column. At this point air pressure will be pumped to proper inlet 110 and outlet 118 for accurate PSI (pounds per square inch). The air pressure will then be forced to jets 84. As the air circulates it will pass through inlet 110 and outlet 118. After air pass through inlet 110 it will continue to flow to outlet 118 back to motor 98. This will become a continuous effect creating the massaging effect desired in bath 83.

Referring to FIG. 13 Alternate position of motor 98 with same instruction as FIGS. 8 and 9.

Additionally, the alternative embodiment will have all the necessary operative and luxury features as provided by conventional whirlpool baths and spas (not shown).

Advantages

From the description above, a number of advantages of my bathtub insert become evident:

(a) With the combination of the top contour design and bottom contour design the desired effect is achieved for the most important support that adheres to the human body.

(b) The insert will be made from top quality materials produced on the market today.

(c) The insert will offer the most comfortable effect from the materials used for the user.

(d) With additional supports and rests throughout the insert, this offers relaxation unknown before.

(e) The convenient location of placement and removal straps, and hanger straps the insert is easy to use.

(f) The insert is designed with the top contour design to provide the user with ultimate comfort and relaxation ever known.

(g) The insert is designed with the bottom contour design to provide the user with support in a proper position that is vital to achieve total comfort and relaxation.

(h) The insert is designed with top quality materials for the maximum safety of the user.

(i) The insert will be easy to manufacture without complex components.

(j) The insert will be made of materials to provide a anti-bacterial, skid-resistant safe surface.

(k) The insert will be easy to use and allows the user minimal instruction.

CONCLUSION, RAMIFICATIONS, AND SCOPE

Thus, the reader will see that the bathtub insert titled "Take Five", will provide maximum comfort, support, and relaxation for the user. The bathtub insert will provide ultimate support to the user for the head, neck, back, legs, and arms. The insert will also be lightweight and can be used by anyone. Furthermore, the bathtub insert has the additional advantages in that

- it permits the production of an array of various colors;
- it permits the production of an array of various ornamental designs;
- it permits the production of various sizes for children and adults alike;
- it permits the production of various variations of materials for manufacture;
- it permits production in various methods;
- it allows the user easy and simple packing for transport;
- the design can be incorporated within shower/bath ensembles;
- the design can be incorporated into showers;
- it permits the production various sizes to accommodate multiple persons;
- it permits the manufacture of a product that is simple to maintain cleanliness;
- it permits the insert to be cost effective and maintenance free;
- it permits the production of various thickness, angles, positions and sizes to accommodate use in any size tub.

Although the description above contains many specificities, these should not be construed as limiting the scope of the invention but as merely providing illustrations of some of the presently preferred embodiments of this invention. For example, the insert can have an accommodating additional support for babies; the insert can be made in various sizes for bathing babies in the bathtub or in the sink; the insert can have handles placed for individuals that need assistance with injury or impaired disabilities, and be of assistance to the elderly. The insert can have the placement/removal straps and hanger straps made integrally as part of the insert and from flexible plastic, durable nylon or rope materials with or without the vinyl layer. The insert can be made with one set of placement/removal straps. The hanger straps can be made and positioned on one end of the insert. The insert can be folded and the attachment cord will encompass the insert and hook to the one hanger strap.

The leg strap, placement and removal straps, and hanger straps can be constructed from an anti-mold, mildew resistant nylon or rope; with or without vinyl layer. The insert can be made without leg supports and leg straps; the leg supports can be made individually in various thickness, angles, positions and sizes to go with the body of the insert.

The insert can be made with pedestal supports individually to go with the body of the insert; the pedestal supports can be made integrally or made separately; or the pedestal supports can be made of high density polyurethane foam and have visco foam topper for maximum comfort; the pedestal supports could be made of high density polyurethane foam only. The pedestal supports can be made in various shapes, angles, and sizes. All variations will be encapsulated with durable vinyl.

The insert can be made with high density non-porous foam with or without visco foam topper, with supports and rest made of non-porous foam, then encapsulated with durable vinyl. The insert can also be constructed of high density polyurethane foam, with or without visco foam topper and optional choice of supports and rest made with polyurethane foam or visco foam and with or without non-porous foam, then encapsulated with durable vinyl. The insert can be made of polyurethane foam, with supports and rest of polyurethane foam, and with or without non-porous foam, then encapsulated with durable vinyl; the insert can be constructed with visco foam and polyurethane foam, with optional supports and rests made of visco or polyurethane foam and with or without non-porous foam, then encapsulated with durable vinyl. The insert can be constructed of visco and non-porous foam, then encapsulated with durable vinyl. The insert can be constructed of visco and non-porous foam, supports and rests of visco or non-porous foam, then encapsulated with durable vinyl. The insert can be constructed of non-porous foam and polyurethane foam with supports and rests of non-porous or polyurethane foam, then encapsulated with durable vinyl. The insert can be constructed with or without non-porous foam and using polyurethane foam and visco foam, then encapsulated in durable vinyl or plastic.

The insert can be constructed of visco foam and durable flexible plastics, then encapsulated in durable vinyl. The insert can be constructed from either polyurethane, non-porous, and/or durable flexible plastics. The insert can be constructed from durable plastics. The durable plastic can be anti-skid plastics or the plastic can be coated with an anti-skid material. The insert can also be encapsulated in durable plastics and or durable vinyl. The insert can be constructed from a durable, flexible plastic with or without a gel textured layer.

The insert can then be encapsulated or dipped in non-skid vinyl. The insert can be made without the rests, and constructed of visco-elastic foam in a thickness to conform to the body. The insert can have various methods and arrangement of material for construction. All various variations of material for the insert can also be encapsulated with durable vinyl in a dipping process. The insert can and will be constructed with the most advanced methods and materials known in technology today.

The insert can be made without the impression folds; control panel can be placed within and encased in the insert, or made as a separate component. The insert can be constructed with suction cups extending the full length of the bottom contour design, including specifically the bottom of the in/out platform, then encapsulated in durable vinyl or coated within a dipping process; the insert can be constructed and glued or mold injected with various polyurethane foams and glued with a visco foam topper.

The in/out platform can be constructed with a more dense sturdy foam and then encapsulated or a dipping process, of durable vinyl. The in/out platform can be made extending from the bottom contour design of thin various polyurethane foams, then a durable plastic layer glued to the top and bottom side of foams, then encapsulated in durable vinyl or by a dipping method. This method can be reversed and with or without either of the materials listed for the in/out platform. The in/out platform can be constructed integrally or separately from the insert. The platform can be constructed from non-skid plastic materials. The platform can be constructed from plastic materials then encapsulated in non-skid vinyl.

The insert can be made without the suction cups, the inset can be encapsulated or by a dipping method for construction with the use of anti-skid materials only, this would prevent any slipping or movement in the tub. The insert can have the arm supports made with a non-corrosive, lightweight flexible metal to provide a stabling device for getting up and down from the insert; the arm supports can be made of various heights, widths, shapes, angles and positions to accommodate the user. The insert can be made without the based support for the arm supports and hand rest.

The insert can be made without the head adjustment. The head adjustment can be made separately, that will be provided and can be used if needed. The insert can be made with the head adjustment that is attached at the top portion. This will allow the adjustment the flexibility of flipping front to back of the head rest. The insert can also be made with only the headrest. In this effort, the headrest will be large enough to fold back and provide enough support for head and neck adjustment. The headrest and head adjustment can be formed in different angles and shapes. The insert can also be constructed with or without the accessory compartment, cup holder, and timer.

The insert can have enlarged sizes constructed to accommodate larger stature individuals; the insert can have enlarged sizes to accommodate multiple persons in whirlpool baths and spas; the insert can have individual sizes to accommodate in whirlpool bath and spas; the insert, whirlpool bath, and spas can have the luxury of production to the exact portion and measurements of an individual, the insert can have a storage ensemble case or bag for convenience of transport. The insert can be made with seams and contours for strength and durability.

The bathtub insert design can be incorporated into new and replacement tubs for the home. The bathtub insert design can be incorporated into whirlpool baths and spas for the home.

The insert has two distinct designs the designs can have a various arrangements of materials for construction, and each can be encapsulated separately with various non-skid materials. Each design will be constructed with materials to ensure safety for the user. After this process, each can be sealed and bonded with materials that will coat the insert for antibacterial protection. This process can also be done with the insert formed integrally with or without non-porous foam and durable vinyl or plastics. Thus at this point, sealed and bonded together with antibacterial protection. In this method the insert can be offered separately to the user. The insert can be constructed from the various material described above for other purposes. This will give the insert versatility outside the bathtub. This will allow the insert to be upholstered in an array of fabrics. This will permit the insert design to be used for unlimited purposes within and outside the home. This will permit the insert design to be used for unlimited purposes to benefit all aspects of daily living.

Thus the scope of the invention should be determined by the appended claims and their legal equivalents, rather than by the examples given.

I claim:

1. A bathtub insert in combination of the type comprising:

a predetermined rectangular body of material having the first section, a top contour design conforming to the curvature of the human body form in an angled position, having a upper back support, a lower back support, and a neck support, extended with a head rest, and extending parallel plurality a arm rest, a hand rest and from a seat support extending parallel plurality a leg support; and a foot rest; and, a predetermined rectangular body of material having the second section, a bottom contour design adjacent to and communicating with heretofore said top contour design, heretofore, said second section, further including, a triangular wedge support extending from end of said angled curvature shape, in disposed position, to create a pedestal support for said leg support of said first section, further including, a head adjustment, in disposed position, whereby vital support is given to said first section and conforming to the curvature of a bathtub, whereby the improvement said insert supports the entire body of the user in an angled position with said first section, supported by said second section and providing vital support to said first section.

2. The insert of claim 1, further including, said thereof, a leg support straps in plurality positioned at end of said angled curvature shape, and positioned between said top contour design and said bottom contour design.

3. The insert of claim 1, further including, said thereof, a placement and removal straps in plurality parallel positioned on opposite sides of said thereof; and a hanger strap on opposite ends of said bottom contour design respectively.

4. The insert of claim 1, further including, said thereof, plurality of a suction cups formed with said bottom contour design to adhere to a bathtub surface.

5. The insert of claim 1, further including, said thereof, a in/out platform to provide a anti-skid vinyl surface, from said second section thereof respectively.

* * * * *